US007831339B2

(12) United States Patent
Kim et al.

(10) Patent No.: US 7,831,339 B2
(45) Date of Patent: Nov. 9, 2010

(54) INTEGRATED MANAGEMENT SYSTEM AND METHOD FOR CONTROLLING MULTI-TYPE AIR CONDITIONERS

(75) Inventors: Jun-Tae Kim, Seoul (KR); Sang-Chul Youn, Seoul (KR); Duck-Gu Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 240 days.

(21) Appl. No.: 11/945,482

(22) Filed: Nov. 27, 2007

(65) Prior Publication Data

US 2008/0185447 A1 Aug. 7, 2008

(30) Foreign Application Priority Data

Feb. 2, 2007 (KR) ..... 10-2007-0011212

(51) Int. Cl.

| | |
|---|---|
| ***G05B 13/00*** | (2006.01) |
| ***G05B 15/00*** | (2006.01) |
| ***G05D 23/00*** | (2006.01) |
| ***G06F 11/00*** | (2006.01) |
| ***G06F 15/16*** | (2006.01) |
| ***G06F 15/173*** | (2006.01) |

(52) U.S. Cl. ..... 700/276; 340/3.32; 340/517; 702/188; 709/203; 709/219; 709/224; 709/232

(58) Field of Classification Search ..... 700/276, 700/277; 702/188; 709/201, 203, 217–219, 709/223, 224, 232; 340/3.1, 3.3, 3.32, 517, 340/521, 522; 236/51

See application file for complete search history.

(56) References Cited

U.S. PATENT DOCUMENTS

| | | | | |
|---|---|---|---|---|
| 5,061,916 | A * | 10/1991 | French et al. | 340/522 |
| 5,739,760 | A * | 4/1998 | Hatakeyama | 340/3.32 |
| 6,647,317 | B2 * | 11/2003 | Takai et al. | 700/276 |
| 6,778,945 | B2 * | 8/2004 | Chassin et al. | 702/188 |
| 6,978,627 | B2 * | 12/2005 | Masui et al. | 62/127 |
| 7,043,339 | B2 * | 5/2006 | Maeda et al. | 700/276 |
| 7,142,112 | B2 * | 11/2006 | Buckingham et al. | 340/545.1 |
| 7,340,909 | B2 * | 3/2008 | Kwon et al. | 62/175 |
| 7,664,573 | B2 * | 2/2010 | Ahmed | 700/276 |
| 7,719,440 | B2 * | 5/2010 | Delp et al. | 340/870.02 |
| 7,734,572 | B2 * | 6/2010 | Wiemeyer et al. | 700/19 |
| 2004/0049524 | A1 * | 3/2004 | Toyota et al. | 707/203 |
| 2004/0117069 | A1 * | 6/2004 | Yoon et al. | 700/276 |
| 2004/0204793 | A1 * | 10/2004 | Yoon et al. | 700/277 |
| 2005/0155368 | A1 | 7/2005 | Oh et al. | |
| 2006/0162353 | A1 | 7/2006 | Ha et al. | |
| 2007/0095084 | A1 | 5/2007 | Park et al. | |
| 2007/0113568 | A1 | 5/2007 | Jang et al. | |
| 2007/0130967 | A1 | 6/2007 | Park et al. | |
| 2009/0139251 | A1 * | 6/2009 | Masui | 62/129 |
| 2010/0097239 | A1 * | 4/2010 | Campbell et al. | 340/825.25 |

FOREIGN PATENT DOCUMENTS

| | | | |
|---|---|---|---|
| EP | 1429083 | A1 * | 6/2004 |
| JP | 2002031391 | A * | 1/2002 |
| JP | 2004198102 | A * | 7/2004 |
| JP | 2004265449 | A * | 9/2004 |

* cited by examiner

*Primary Examiner*—Crystal J Barnes-Bullock
(74) *Attorney, Agent, or Firm*—KED & Associates, LLP

(57) ABSTRACT

An integrated management system for controlling multi-type air conditioners can reduce a communication load by transmitting only changed operation state information among operation state information related to at least one air conditioner system which is disposed in a room or office and is being operated.

5 Claims, 3 Drawing Sheets

INTEGRATED MANAGEMENT SYSTEM AND METHOD FOR CONTROLLING MULTI-TYPE AIR CONDITIONERS

BACKGROUND OF THE INVENTION

1. Field of the Invention

The present invention relates to an integrated management system and method for controlling multi-type air conditioners, and more particularly, to an integrated management system and method for controlling multi-type air conditioners which is capable of detecting a change in information about operation states of at least one air conditioner group and integrally controlling the operation of the at least one air conditioner group based on the detected result.

2. Description of the Background Art

With a recent increase in the use of air conditioning systems, air conditioning systems are now used in most buildings and homes. As one type of air conditioning system, so-called "multi-type air conditioners" include indoor units disposed in each room of a home or in each office in an office building, and an outdoor unit shared by and connected to the indoor units.

An air conditioner group denotes a system having a plurality of air conditioners, and an air conditioner system denotes a system for managing at least one air conditioner group.

The air conditioner system may include a local controller which detects operation states of a plurality of air conditioner groups and, according to the detection, controls the plurality of air conditioner groups via a gateway.

Recently, an integrated management system for controlling the multi-type air conditioners is being developed to integrally manage at least one air conditioner system from a distance.

Such integrated management system for controlling the multi-type air conditioners may collect operation state information related to the air conditioner system having the multi-type air conditioners and setting information related to the local controller for the multi-type air conditioners so as to store and manage such information in a database. Thus, when the air conditioner system is not working properly, the integrated management system can automatically detect the malfunction or error and rapidly repair it.

Here, while communicating with the plurality of air conditioners, the local controller collects operation status information related to a plurality of indoor units and outdoor units that are connected to the multi-type air conditioners.

The data collected by the local controller include various types of data such as operation state information related to the indoor units (e.g., on/off mode, wind direction, amount of wind, temperature, lock/unlock mode, etc.) and operation state information related to the outdoor units (e.g., states of a compressor, fan speed, valve lock, temperature, etc.).

In the operation of the related art integrated management system for controlling the multi-type air conditioners, the local controller collects state information related to the multi-type air conditioners and transmits the collected state information to a remote integrated management system at every specific interval.

However, the data to be transmitted at every specific interval include all operation state information, thereby increasing an amount of data. Accordingly, when such data is transmitted, a network load would increase. Also, since the amount of data to be stored in the remote integrated management system would increase, CPU and disk I/O loads used for storing data in and searching a database server would increase.

That is, the related art integrated management system for controlling the multi-type air conditioners periodically transmits all collected information related to the multi-type air conditioners to the remote integrated management system. Accordingly, it is difficult to manage the database, and the CPU and disk I/O loads to process all of such information increase.

SUMMARY OF THE INVENTION

Therefore, in order to solve those problems of the related art, it is an object of the present invention to provide an integrated management system and method for controlling multi-type air conditioners capable of reducing a network load and storage and search loads of a database by receiving and analyzing only changed information among operation states of at least one air conditioner system, which is disposed in a particular area (e.g., a room or office) and is being operated.

To achieve these and other advantages and in accordance with the purpose of the present invention, as embodied and broadly described herein, there is provided an integrated management system for controlling multi-type air conditioners according to one embodiment of the present invention, comprising: one or more air conditioner systems having one or more air conditioner groups provided with a local controller connected to multi-type air conditioners via a gateway, and configured to detect changes in operation state information related to the one or more air conditioner groups and convert the operation state information based on the detected result into operation state information data according to a remote communication protocol so as to transmit the converted data; and a remote integrated management system configured to receive the operation state information data based on the remote communication protocol from the one or more air conditioner systems and remotely control the one or more air conditioner systems based on the received operation state information data.

Here, the local controller includes a collecting module configured to collect operation state information at a specific interval; an analyzing module configured to analyze the operation state information collected in the collecting module and detect changes in the operation state information; and a transmitting module configured to convert the changed operation state information into operation state information data according to a remote communication protocol and transmit the converted data, based on the result detected by the analyzing module.

Further, the remote integrated management system is provided with an application server which receives the changed operation state information, stores the received operation state information in a database server, and converts the changed operation state information based on operation control data into operation state information data according to a remote communication protocol for transmission.

To achieve these and other advantages and in accordance with the purpose of the present invention, as embodied and broadly described herein, there is provided an integrated management method for controlling multi-type air conditioners according to one embodiment of the present invention, comprising: collecting operation state information related to one or more air conditioners; analyzing the collected operation state information; and compressing and transmitting changed operation state information, if a change in the operation state information is detected according to the analysis result.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE INVENTION

Description will now be given in detail of the preferred embodiments of the present invention, examples of which are illustrated in the accompanying drawings.

Figure 1:
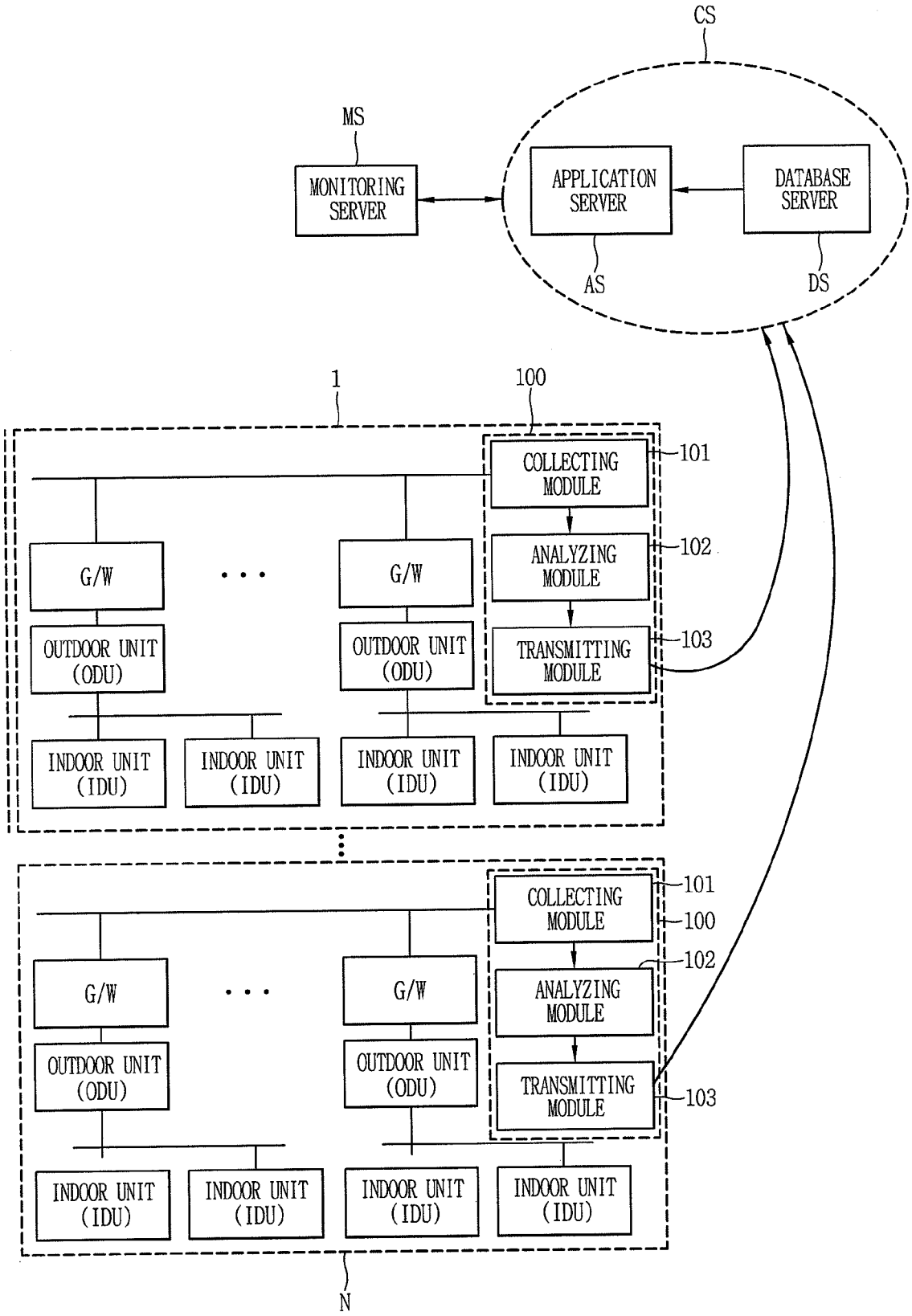
FIG. 1 is a schematic block diagram illustrating an integrated management system for controlling multi-type air conditioners according to one embodiment of the present invention.

FIG. 1 is a schematic block diagram illustrating an integrated management system for controlling multi-type air conditioners according to one embodiment of the present invention.

As shown in FIG. 1, there are provided a plurality of air conditioner systems 1 to N, a remote integrated management system CS, and a monitoring sever MS.

The plurality of air conditioner systems 1 to N includes one or more air conditioner groups each having a local controller connected to multi-type air conditioners via a gateway GW, detects a change in operation state information related to the one or more air conditioner groups, and converts the operation state information based on the detected result into operation state information data according to a remote communication protocol, to thusly transmit the converted data.

For reference, the plurality of air conditioner groups denotes installed air conditioning facilities including multi-type air conditioners capable of satisfying heating/cooling requirements of a corresponding building by connecting at least one indoor unit with one outdoor unit. The plurality of air conditioner groups allow not only to separately control each of the air conditioners using an indoor unit disposed in each room or space but also to integrally control every air conditioner in a building from a certain location by means of a local controller.

Here, the local controller 100 includes a collecting module 101 configured to collect operation state information at specific intervals, an analyzing module 102 configured to analyze the operation state information collected by the collecting module 101 and detect changes in the operation state information, and a transmitting module 103, configured to convert any changed operation state information based on the analysis result of the analyzing module 102 into operation state information data according to a remote communication protocol, to transmit the thusly converted data.

The collecting module 101 includes first and second buffers that store operation state information in a first-in, first-out manner.

The transmitting module 103 serves to compress and transmit that operation state information having changed, and includes various wired/wireless communication modules.

The remote integrated management system CS then receives the operation state information data based on the remote communication protocol from the one or more air conditioner systems 1 to N, and remotely controls the one or more air conditioner systems 1 to N based on the received operation state information data.

The remote integrated management system CS is provided with an application server AS which receives the changed operation state information, stores the received operation state information into a database server DB, and converts the changed operation state information into operation control data according to the remote communication protocol for transmission.

Also, the remote integrated management system CS may further include a monitoring server MS for displaying desired operation state information of interest related to the plurality of the air conditioner systems 1 to N such as information that a service manager wants to know.

Figure 2:
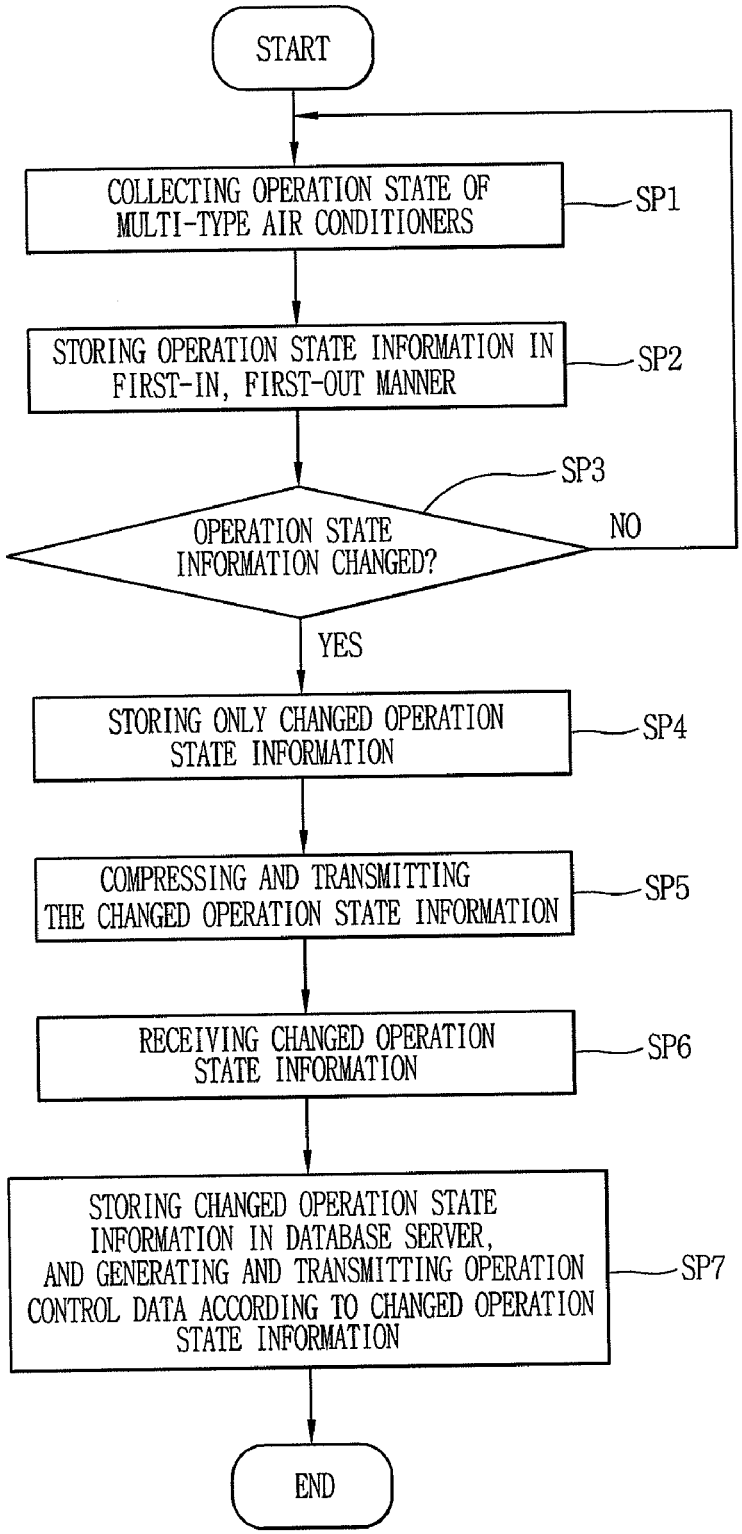
FIG. 2 is a flowchart illustrating an operation of an integrated management method for controlling multi-type air conditioners according to the present invention.

The operation of the remote management system for controlling the multi-type air conditioners according to the present invention having such configuration will now be described with reference to FIG. 2.

First, according to the present invention, the local controller 100 of the plurality of air conditioner systems 1 to N is preset to collect and analyze operation state information at specific intervals, and to transmit the operation state information based on the analysis result.

The remote integrated management system CS receives operation state information from at least one air conditioner system 1 to N, then classifies the received operation state information, and then controls the at least one air conditioner system 1 to N according to the operation state information.

Detailed description of an exemplary co-operation between one air conditioner system 1 to N and the remote integrated management system CS will now be given.

First, the local controller 100 of the air conditioner system 1 to N collects and analyzes operation state information at specific intervals, and if it is determined as a result of the analysis that a change in the operation state information has occurred, transmits the changed operation state information to the remote integrated management system (SP1~SP5).

Now, the operation of the local controller 100 will be described in detail.

First, the collecting module 101 of the local controller 100 collects operation state information related to the multi-type air conditioners connected thereto at a specific interval (SP1).

Here, the collecting module 101 includes two buffers, and temporarily stores the collected operation state information into the two buffers in a first-in and first-out (FIFO) manner (SP2).

Next, the analyzing module 102 of the local controller 100 compares the operation state information stored in the two buffers of the collecting module 101 with each other. If any change is detected (SP3), the analyzing module 102 applies only the changed operation state information to the transmitting module 103 (SP4).

Accordingly, the transmitting module 103 of the local controller 100 compresses the applied changed operation state information, and then transmits the compressed changed operation state information to the remote integrated management system CS via a network (e.g., an available wireless network) (SP5).

Figure 3:
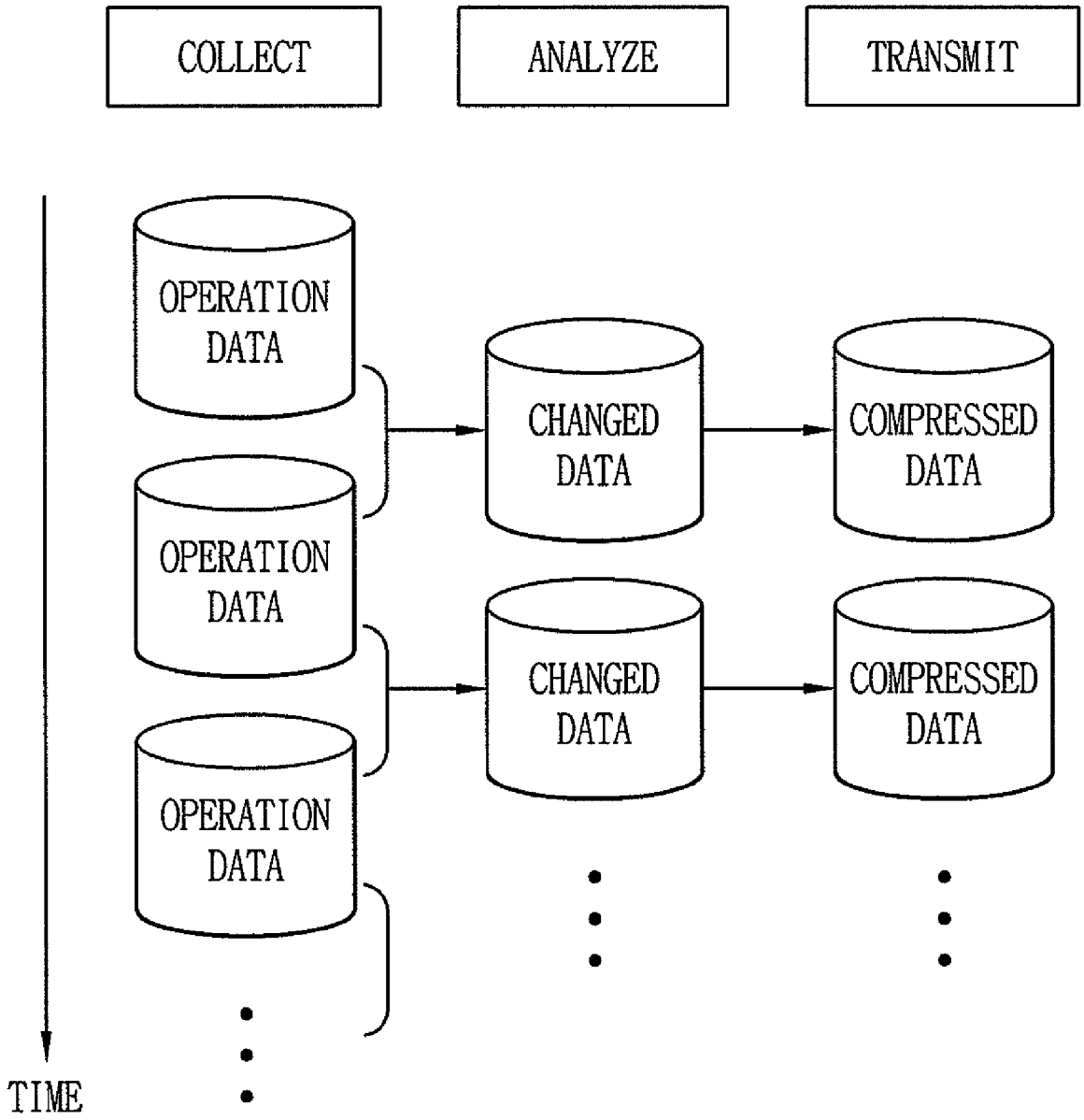
FIG. 3 is a schematic view illustrating a process that a change in operation status information in FIG. 1 is checked and transmitted by a local controller.

FIG. 3 is a schematic view illustrating the process by which a change in operation state information is checked and transmitted by the local controller 100.

The application server AS of the remote integrated management system CS receives operation state information from the local controller 100 (SP6), stores the received operation state information into the database server DS, and also converts the received operation state information into operation control data according to a remote communication protocol so as to transmit the converted data to the local controller 100 of the plurality of air conditioner systems 1 to N (SP7).

Accordingly, the local controller 100 of the plurality of air conditioner systems 1 to N operates the multi-type air conditioners connected thereto, based on the operation control data.

That is, in accordance with the present invention, the collecting module of the local controller provided for the plurality of air conditioner systems collects operation state information related to the multi-type air conditioners at specific intervals (within a few seconds), and temporarily stores the collected operation state information sequentially in the FIFO buffer. In other words, the collected information is stored in a NEW buffer first, and if other information is then collected, data in the NEW buffer is moved to an OLD buffer, thereby storing the newly collected data into the NEW buffer.

As mentioned above, the operation state information temporarily stored in the two buffers is analyzed. According to the analysis, if the operation state information has changed, the changed operation state information is compressed and transmitted to the remote integrated management system. Accordingly, the changed operation state information is stored and managed by the database server of the remote integrated management system.

The integrated management system for controlling multi-type air conditioners of the present invention can be applied to a system comprised of multi-type air conditioners and single-type air conditioners, as well as a system comprised of only multi-type air conditioners.

The preferred embodiments of the present invention have been described in detail with reference to the drawings; however, they should not be construed as limiting the scope of the present invention. Also, it will be obvious to those skilled in the art that variations may be implemented within the scope as defined by the appended claims.

As described above, the integrated management system for controlling multi-type air conditioners according to the present invention can transmit only the changed operation state information among operation state information related to at least one air conditioner system, which is disposed in a room/office and is being operated, thereby reducing the communication load.

In addition, the integrated management system for controlling multi-type air conditioners according to the present invention stores and manages only the changed operation state information, thereby reducing a process load of a database system.

The foregoing embodiments and advantages are merely exemplary and are not to be construed as limiting the present disclosure. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An integrated management system for controlling multi-type air conditioners, comprising:

one or more air conditioner systems having one or more air conditioner groups provided with a local controller connected to multi-type air conditioners via a gateway, and configured to detect changes in operation state information related to the one or more air conditioner groups and convert the changed operation state information based on the detected result into operation state information data according to a remote communication protocol for transmission; and a remote integrated management system configured to receive the operation state information data based on the remote communication protocol from the one or more air conditioner systems and remotely control the one or more air conditioner systems based on the received operation state information data, wherein the remote integrated management system includes a database server, and an application server for receiving the changed operation state information, storing the received operation state information in the database server and converting the changed operation state information into operation control data according to a remote communication protocol for transmission, wherein the local controller includes:

a collecting module to collect operation state information at specific intervals, and store the operation state information in a FIFO buffer in a first-in, first-out manner, the FIFO buffer including a first buffer to store present operation state information and a second buffer to store previous operation state information, an analyzing module to analyze the operation state information collected by the collecting module based on a comparison of the present operation state information in the first buffer and the previous operation state information in the second buffer, and the analyzing module to detect the changes in the operation state information based on a result of the comparison, and a transmitting module to convert the changed operation state information based on the detected result of the analyzing module into operation state information data according to the remote communication protocol for transmission.

2. The integrated management system of claim 1, wherein the transmitting module compresses and transmits the changed operation state information.

3. The integrated management system of claim 1, wherein the remote integrated management system further includes a monitoring server for displaying desired operation state information of interest related to the one or more air conditioner systems.

4. An integrated management method for controlling multi-type air conditioners that include one or more air conditioner systems having one or more air conditioner groups provided with a local controller coupled to multi-type air conditioners via a gateway, the method comprising:

collecting operation state information related to the one or more air conditioners, storing the collected operation state information in a FIFO buffer that includes a first buffer to store present operation state information and a second buffer to store previous operation state information, the FIFO buffer operating in a first-in, first-out manner;

comparing the operation state information in the first buffer with the operation state information in the second buffer;

analyzing the operation state information by detecting changes in the operation state information based on the comparing; and when a change in the operation state information is detected according to a result of the analyzing, compressing and transmitting the changed operation state information.

5. The integrated management method of claim 4, further comprising;

analyzing the changed operation state information, and based on the analysis result, generating and transmitting operation control data.

* * * * *